United States Patent [19]

Ahlers et al.

[11] Patent Number: 5,040,354

[45] Date of Patent: Aug. 20, 1991

[54] ARRANGEMENT FOR CLEANING CAPPING MECHANISMS OF A ROTARY-TYPE CAPPING MACHINE

[75] Inventors: Egon Ahlers, Neu-Bamberg; Herbert Bernhard, Wolfsheim; Clüsserath, Bad Kreuznach; Axel Theine, Wöllstein, all of Fed. Rep. of Germany

[73] Assignee: Seitz Enzinger Noll, Mannheim, Fed. Rep. of Germany

[21] Appl. No.: 530,651

[22] Filed: May 30, 1990

[30] Foreign Application Priority Data

Jun. 7, 1989 [DE] Fed. Rep.-of Germany ..... 3918504

[51] Int. Cl.[5] ..... B65B 7/28; B65B 65/00; B67B 3/10; B67B 3/12

[52] U.S. Cl. ..... 53/167; 53/342; 53/359

[58] Field of Search ..... 53/167, 306, 308, 328, 53/329, 342, 359, 281, 282; 141/90, 91

[56] References Cited

U.S. PATENT DOCUMENTS

| | | | |
|---|---|---|---|
| 4,205,502 | 6/1980 | Ahlers | 53/308 |
| 4,389,833 | 6/1983 | Knabe | 53/167 |
| 4,527,377 | 7/1985 | Hayashi et al. | 53/167 |
| 4,530,202 | 7/1985 | Powell et al. | 141/91 X |
| 4,730,631 | 3/1988 | Schwartz | 141/91 X |
| 4,964,444 | 10/1990 | Hanérus et al. | 141/90 |

*Primary Examiner*—Horace M. Culver

*Attorney, Agent, or Firm*—Robert W. Becker & Associates

[57] ABSTRACT

A rotary-type capping machine is provided for capping bottles with closure caps. A plurality of capping elements are provided that rotate about a vertical machine axis and can be raised and lowered in the vertical direction. To clean the capping elements, rinsing caps can be secured thereon, each of which, when secured on a capping element, closes off toward the outside a rinsing chamber in which are disposed at least those surfaces of the capping element for which cleanliness is particularly critical. To avoid a connection and loosening of hoses or conduits during cleaning, each capping element is provided above a rinsing cap connection area with fixed connections for the supply and withdrawal of a cleaning or rinsing agent. If the capping machine has a cap transfer mechanism with a rotating transfer element, to clean the same a tray-like element for a cleaning agent is provided in which the transfer element can be immersed by lowering the cap transfer mechasnism and/or by raising the tray-like element.

30 Claims, 3 Drawing Sheets

ARRANGEMENT FOR CLEANING CAPPING MECHANISMS OF A ROTARY-TYPE CAPPING MACHINE

BACKGROUND OF THE INVENTION

The present invention relates to a closure or capping machine of rotary design to cap bottles that have lips on their mouths with closure caps, such as crown closures, crown corks, etc., that are supplied from a magazine via a cap feeding channel that leads therefrom, with the capping being effected via a plurality of closure or capping elements that rotate about a vertical axis of the machine and can each be raised and lowered in a vertical direction. To press and subsequently permanently deform or set the closure caps on the bottle mouths, each of the capping elements is provided with a deforming member accommodated in a capping element part and with a hold-down device that extends centrally through the deforming member and to the region of the lower end of which closure caps are fed via a cap transfer mechanism that is disposed downstream of the feeding channel. Alternatively, each of the capping elements can be provided with a deforming member and a hold-down device that extends centrally through the deforming member, with the deforming member and the hold-down device being movable relative to one another, and with a member of a cap transfer mechanism, which member is disposed downstream of the feeding channel and is driven synchronously with the rotation of the capping elements, transferring a respective one of the closure caps to holding means at the lower end of the hold-down device of each capping element that moves past a transfer position of the cap transfer mechanism.

Capping machines of this type are known (U.S. Pat. No. 3,807,133) and are characterized in particular by a reliable and problem-free manner of operation if the transfer of the individual closure caps to the capping elements, or to the hold-down devices thereof, is effected with the aid of a cap transfer mechanism that is provided with a rotating transfer element. With capping machines of this type, it is also known (U.S. Pat. No. 4,205,502) to provide at the lower region of each capping element a centering member in order in this way to additionally ensure a satisfactory centering of the bottles, and hence a satisfactory closure formation, without damaging the mouths of the bottles.

It is furthermore known (U.S. Pat. No. 4,527,377), with capping machines to undertake cleaning or disinfecting measures, in particular of those elements that come into contact with the mouth region of the bottles as well as with the closure caps during the capping process, in order to obtain, for the contents dispensed into the bottles, an optimum protection against contamination or bacteria (in particular also yeast), and hence an optimum shelf life. To clean the capping elements, cleaning caps or rinsing caps are placed thereon. A drawback of these heretofore known capping machines is that connections for hoses or conduits for supplying and withdrawing the rinsing agent are provided directly on the rinsing cap. This is necessary with the heretofore known capping machines because the rinsing caps are secured on a sleeve-like element of the respective capping element that surrounds the capping element part that is provided with the deforming member; this means a work intensive connection or separation prior to or after a cleaning process. Furthermore, with these heretofore known capping machines, i.e. with the rinsing caps thereof, O-rings are provided that when the rinsing caps are placed on, ensure a separation of the flow paths for the supplied and withdrawn rinsing agent. For this purpose, the O-rings rest either against the underside of the centering member or of the hold-down device of the respective capping element, i.e. against surfaces that similarly must be cleaned. Thus, with these heretofore known capping machines a complete cleaning cannot be provided.

It is therefore an object of the present invention to provide a capping machine that enables a simplified yet improved cleaning of the critical elements and functional parts of the capping machine.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
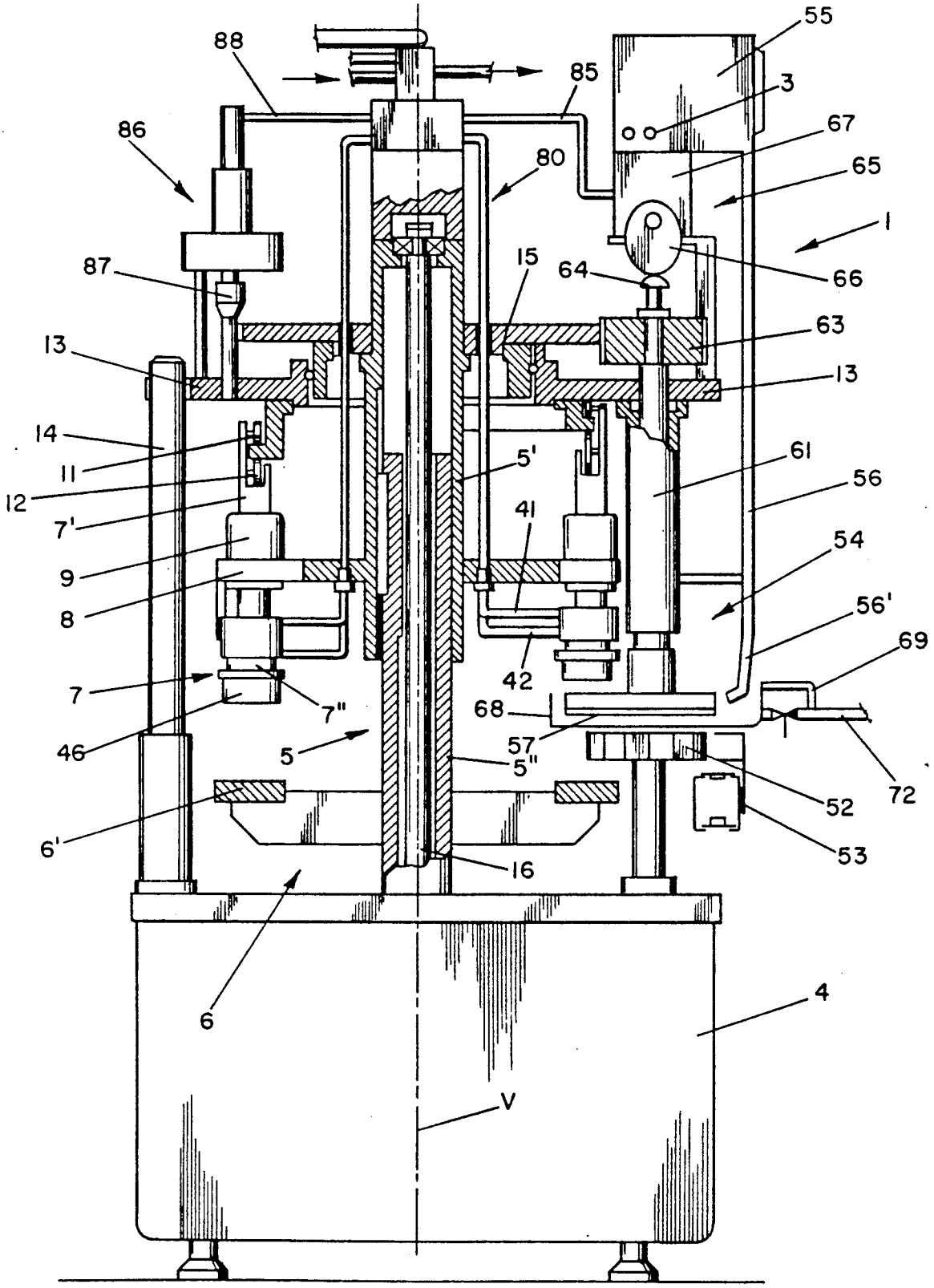
FIG. 1 is a partially cross-sectioned side view of one exemplary embodiment of the inventive bottle capping machine.

One embodiment of the inventive capping machine is characterized by: rinsing caps that can respectively be removably secured to a rinsing cap connection area provided on a lower portion of each capping element on the capping element part thereof, with each rinsing cap, in a secured-to-a-capping element state, closing off toward the bottom a rinsing chamber in which are disposed the deforming member as well as the hold-down device, at least the lower end thereof, i.e. the entire end face at this end and at least a portion of an adjoining peripheral surface; and connection means provided on the capping element above the rinsing cap connection area for the supply and withdrawal of a cleaning or rinsing agent.

Another embodiment of the inventive capping machine is characterized primarily in that: below the cap transfer mechanism, a tray-like element is provided that is open toward the top and is adapted to accommodate cleaning or rinsing agents; and at least one of the cap transfer mechanism and the tray-like element is disposed on a machine frame structure in such a way as to be movable relative to one another in such a way that in a first position, the member of the cap transfer mechanism is disposed above the tray-like element, i.e. above the level of cleaning or rinsing agent therein, and in a second position, the member of the cap transfer mechanism is immersed in the tray-like element, i.e. in cleaning or rinsing agent therein. In the second position, a portion of the cap feeding channel ending at the cap transfer mechanism can also be immersed in the tray-like element, i.e. in cleaning or rinsing agent therein.

If the closure cap transfer mechanism is provided with a transfer member, the inventive capping machine is preferably provided with a combination of the features of the two aforementioned embodiments.

While maintaining the fundamental advantages of a capping machine of the initially mentioned type, the capping machine of the present invention is characterized, for example, by a simplified cleaning of the capping elements, since when the rinsing caps are applied or removed, it is no longer necessary to connect or remove hoses or conduits. Since with the inventive capping machine the rinsing cap connection area is provided on the capping element part that is also provided with or carries the deforming member, i.e. the respective rinsing cap is secured directly to this capping element part, it is also possible to provide the connections for the supply and withdrawal of the cleaning or rinsing agent on the capping element rather than on the rinsing cap.

The inventive construction furthermore ensures that during cleaning of the capping elements, all of the parts of each capping element for which cleanliness and freedom from bacteria is critical are taken care of by the rinsing agent, i.e. have rinsing agent flow intensively thereabout, thereby resulting in a considerably improved cleaning. In addition, the inventive construction requires no seals on the rinsing caps that cooperate with such surfaces of the capping elements that during the capping process come into contact with the closure caps or with the mouth region of the bottles.

The inventive configuration furthermore enables a simplified and improved cleaning of the cap transfer mechanism or transfer device thereof. In addition, the present invention also offers the possibility, utilizing the connections that serve for the supplying of the cleaning or rinsing agent (for example rinsing liquid), of undertaking a $CO_2$ rinsing during the capping of the bottles, i.e. supplying the mouth region of the bottles that are to be capped with a $CO_2$ gas prior to and during the closure formation in order in this way to displace via the $CO_2$ gas in particular such air or oxygen that, after the bottles have been filled, enters the space left within the bottle above the level of the contents. This rinsing with $CO_2$ gas also contributes to an improved shelf life of the contents in the closed bottles.

Further specific features of the present invention will be described in detail subsequently.

DESCRIPTION OF THE PREFERRED EMBODIMENTS

Referring now to the drawings in detail, the closure or capping machine 1 that is illustrated in the drawings, and which is, for example, a single unit, though preferably is part of a combined unit that is also provided with a non-illustrated filling machine, serves to cap bottles 2 via crown corks or caps 3.

The capping machine 1 is of rotary design and, above a base portion 4 of the machine in which, in particular, drive and control elements are accommodated, is consequently provided in a known manner with a able 6 that surrounds the machine axis V on a hollow shaft that is coaxial with the vertical machine axis V and is rotatably mounted in the base portion 4 of the machine. The table 6 has a spiked-wheel configuration and on the upper side of its outer, ring-like portion 6' forms support surfaces for the bases of the upright bottles 2. Provided above the portion 6' are closure or capping elements that are distributed in a uniform angular spacing about the machine axis V. The capping elements 7 are mounted in such a way that they are displaceable in a vertical direction on a disk-like bracket 8 that is also disposed on the hollow shaft 5, or more specifically on a support mounting 9 that is provided at the bracket 8 for each capping element 7, so that as the table 6 as well as the bracket 8 rotates, each capping element 7, which is controlled by a lift or travel cam 10 that surrounds the machine axis V, in a known manner is moved downwardly in a vertical direction to cap the bottles 2 with the crown corks 3, and is subsequently again moved upwardly. For this purpose, each capping element 7 is provided with an upper portion 7' that cooperates via guide rollers 11 and 12 with the lift or travel cam 10, which is provided on the underside of a fixed bracket 13. To adapt the capping machine 1 to different bottle sizes, the bracket 13 can be adjusted in the vertical direction and in this connection is guided on a column 14 to prevent rotation. Furthermore, rotatably mounted in the center of the bracket 13 is a gear wheel 15 that is secured to the hollow shaft 5. For the aforementioned adjustment or adaptation of the capping machine 1 to different bottle sizes, both the gear wheel 15 as well as the bracket 8 with its capping elements 7 can also be adjusted in the vertical direction relative to the table 6. For this purpose, the hollow shaft 5 comprises two telescopically interengaging portions 5' and 5'', with the upper portion 5' being provided with the gear wheel 15 as well as the bracket 8, and the lower portion 5'' being provided with the table 6. Both of the portions 5' and 5'' are drivingly interconnected in the direction of rotation of the hollow shaft 5, yet can be shifted relative to one another in the axial direction. To adjust the height or adapt the capping machine 1 to various bottle sizes, a spindle 16 that is coaxial with the machine axis V and serves as a lifting member is provided within the hollow shaft 5. The spindle 16 cooperates with an adjustment mechanism that is accommodated in the base portion 4 of the machine. The upper end of the spindle 16 is rotatably mounted on the upper region of the portion 5'.

Figure 3:
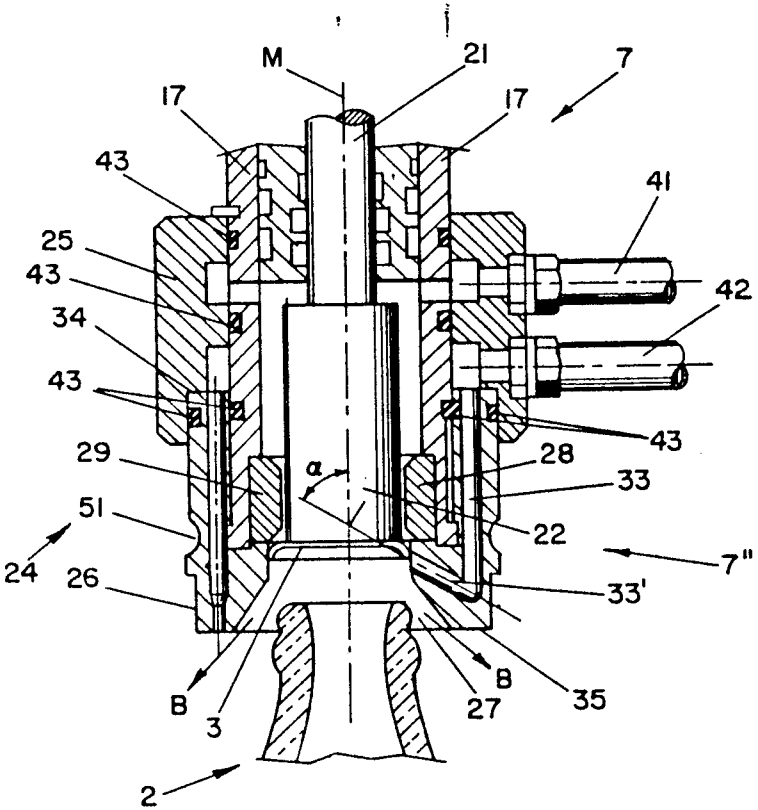
FIG. 3 is a view similar to that of FIG. 2 of one of the capping elements, yet in a partially lowered position and together with a bottle that is to be capped, with only the upper end of the bottle neck that is provided with the mouth being shown.
Figure 2:
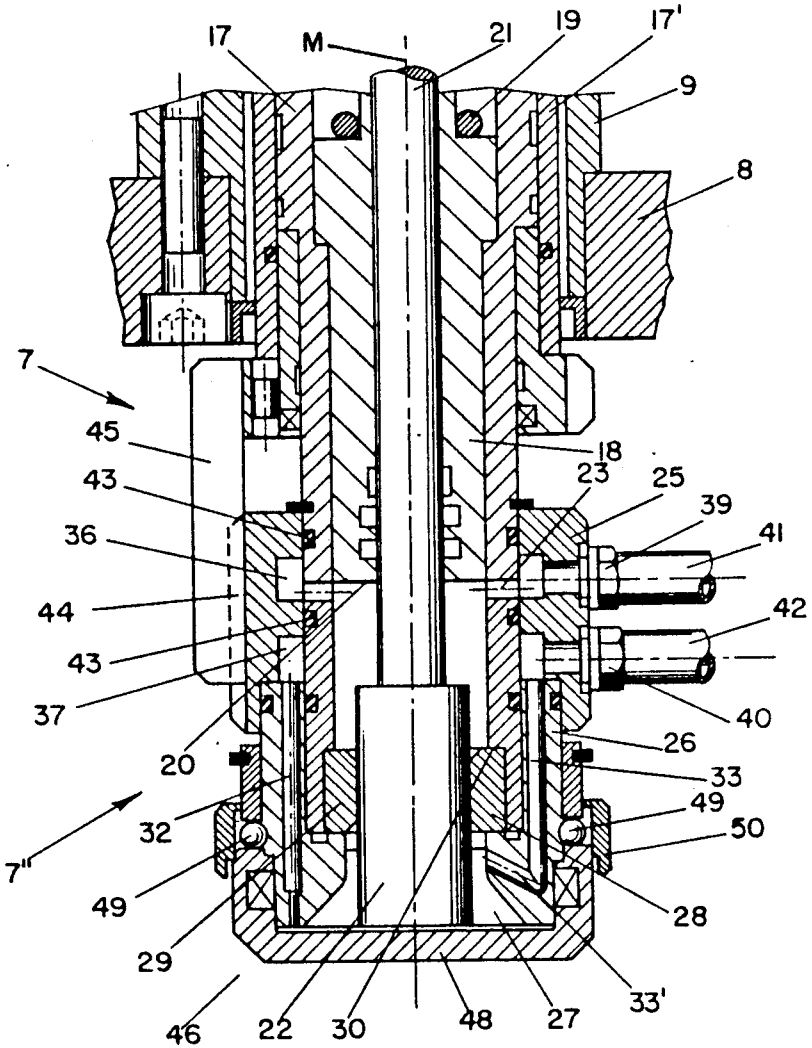
FIG. 2 is a cross-sectional view through a lower portion of one of the capping elements of the capping machine of FIG. 1, together with a rinsing cap that is placed thereon, with the capping element being shown in its uppermost raised position.
Figure 5:
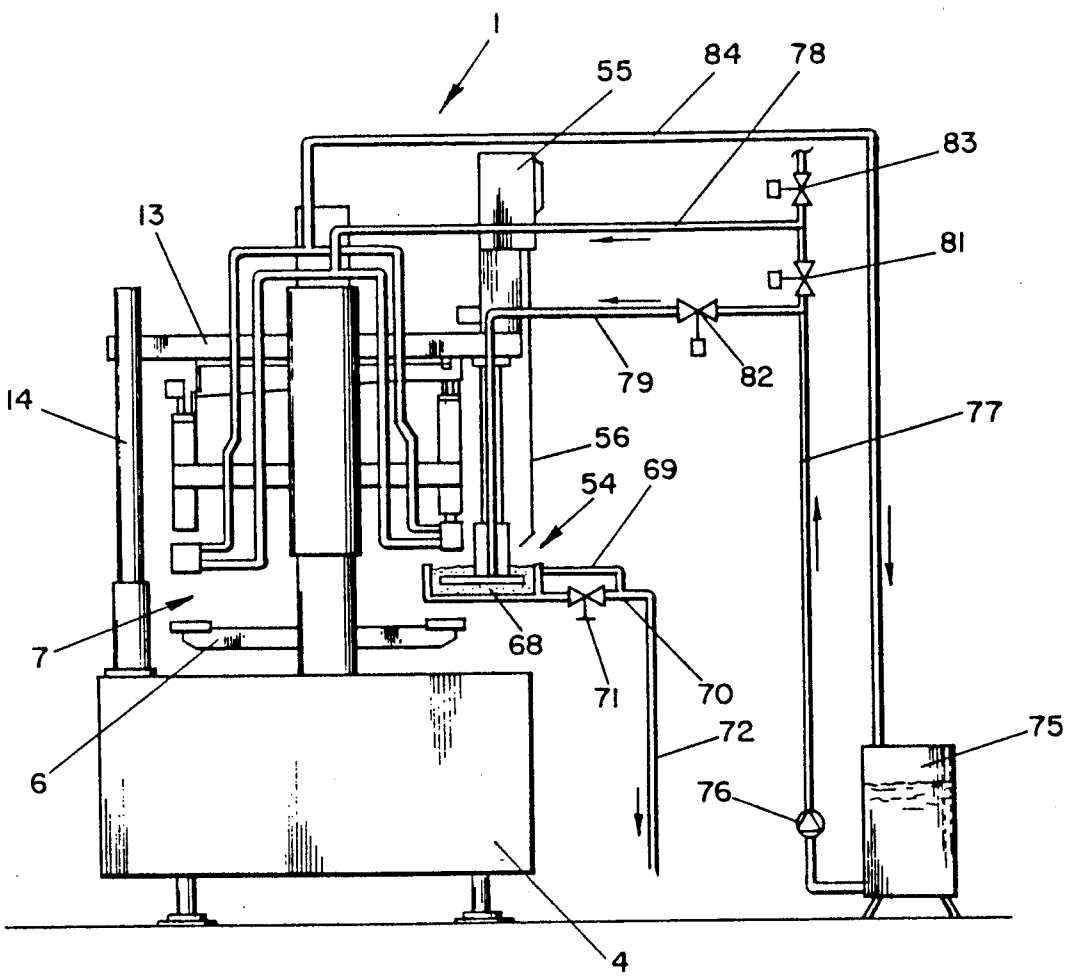
FIG. 5 is a simplified diagram of the capping machine of FIG. 1 together with the external connections and functional elements needed for cleaning and disinfecting the capping elements and cap transfer mechanism as well as for a rinsing with inert gas ($CO_2$ gas).

As shown in FIGS. 2 and 3, the lower portion 7'' of each capping element 7 comprises an outer sleeve-like element 17' that in the previously described manner is disposed in a respective support mounting 9 in such a way that it is displaceable in the vertical direction and also forms the upper portion 7' of the respective capping element 7 with the guide rollers 11 and 12. Disposed in the element 17' is a further element 17 that can be displaced upwardly by a certain amount in the vertical direction and in its axial direction against the effect of a non-illustrated compression spring relative to the element 17', and hence to the portion 7'. Disposed in the sleeve-like element 17 is a third sleeve-like element 18, which can be shifted upwardly in a vertical direction relative to the element 17 out of a rest position, as illustrated in FIGS. 2 and 3, against the effect of a compression spring 19. In the vertical direction, the lower end of the sleeve-like element 18 is disposed above the lower end of the element 17 so that within the element 17, below the element 18, a space is formed that is limited at the top by the lower end of the element 18, i.e. by the end face 20 at that end of the element 18.

The sleeve-like element 18 surrounds a rod 21 that is guided in this sleeve-like element in such a way that a relative movement is possible between the rod 21 and the sleeve-like element 18. At the bottom end, the rod 21 is provided with an essentially cylindrical ram-like hold-down device 22 that is coaxial with the rod 21; the hold-down device 22 is formed at least partially from a permanent magnet. Since both the rod 21 and the hold-down 22 have an outer diameter that is less than the inner diameter of the sleeve-like element 17, a space 23 is formed in the interior of this element below the element 18, i.e. the end face 20 thereof. Although this space 23 has an annular configuration regardless of the respective operating position of the capping element 7, depending upon the operating position this space can surround part of both the rod 21 and the hold-down device 22, or only the hold-down device 22 (when the capping element 7 is in its lowermost stroke position). A ring-like element 24 is placed upon the lower portion of the element 17. In the illustrated embodiment, this element 24 has two parts, including an upper ring portion 25 and a lower ring portion 26, which forms a centering member. Where the lower ring portion 26 extends beyond the lower, open end of the element 17, it is provided with a recess 27, the upper portion of which is essentially cylindrical while the lower portion thereof expands downwardly in a conical manner. The axis of the recess 27 is coaxial with the vertical central axis M of the pertaining capping element 7. The recess 27 itself is open toward the underside and at its upper end opens into an annular gap 28 that in all of the operating positions of the capping element 7 is essentially formed between the outer surface of the hold-down device 22 and the inner surface of a ring 29. The ring 29 is the conventional deforming member of crown cork capping machines, with this member frequently also being designated as a capping cone and serving to press the rim of the closure cap or crown cork beneath or behind the lip or bead of the mouth of the bottle 2 that is to be capped. Above the ring 29, the annular gap 28 communicates with the space 23. In the vicinity of the lower, open end of the element 17, the ring 29 is held or clamped between the lower ring portion 26 and this element 17, i.e. a shoulder 30 formed thereon at that end. The element 17 consequently forms that capping element portion that is provided with the deforming member, namely the ring 29.

Formed in the portion 26 are two separate channels 32 and 33, with the channel 32, over its entire length, extending linearly and parallel to the central axis M of the capping element 7 from the upper annular end face 34 to the other, similarly annular end face 35 of the portion 26, with the end face 35 extending about the opening of the recess 27 located there. The channel 32 is open both at the upper end face 34 as well as at the lower end face 35, although in the illustrated embodiment, the cross-sectional area of the channel 32 is reduced in the vicinity of the end face 35. The channel 33, which is similarly open at the upper end face 34, extends (starting from the end face 34), in the portion 26, first over a large part of the length thereof parallel to the central axis M of the capping element 7 in a downward direction, and then extends in an angled portion 33' in such a way that this portion of the channel 33 opens in the interior of the recess 27, and in particular at a distance from the lower end face of the ring 29 that is less than the vertical distance to the end face 35. In the illustrated embodiment, the portion 33 opens approximately where the lower, conical part of the recess 27 merges with the essentially cylindrical upper portion thereof.

The upper ring portion 25, which is disposed at a greater distance from the lower end of the capping element 7, extends about the sleeve-like element 17 as well as the portion 26 in the vicinity of the end face 34 thereof. Formed in the portion 25 are two annular channels 36 and 37 that concentrically surround the central axis M of the capping element and are offset from one another in the direction of the central axis M. By means of a plurality of through bores or holes 38 in the wall of the sleeve-like element 17, the upper channel 36 communicates with the annular space 23, and the lower channel 37 communicates with the channels 32 and 33, and in particular via the openings of the channels 32 and 33 provided at the end face 34. Also provided at the portion 25 are two connections 39 and 40 for two hoses or conduits 41 and 42, with the connection 39 that is connected to the annular channel 36 being intended for the conduit 41, and with the connection 40 that is connected with the annular channel 37 being intended for the conduit 42.

O-rings 43 ar provided between the portion 25 and the outer surface of the element 17, between the portion 26 and the outer surface of the element 17, as well as between the portions 25 and 26; these O-rings 43 in particular also seal off the annular channels 36 and 37 toward the outside.

Also provided on the outer surface of the portion 25, across from the connections 39 and 40, is a guide slot 44 that extends parallel to the central axis M and extends over the outer side of the portion 25. To prevent turning of the portion 25, a vertical guide rod 45 engages the guide slot 44. One end of the guide rod 45 is secured to a shoulder that is connected to the element 17' and projects beyond the underside of its bracket. It is to be understood that other measures could also be used to prevent the portions 25 of the capping elements 7 from turning. As will be described in detail subsequently, to allow for the cleaning and disinfecting of the capping elements 7 at their particularly critical areas (recess 27, outer surfaces of the hold-down device 22, ring 29, annular space 23, and end face 35), for each capping element 7 a rinsing cap 46 is provided that can be placed upon the lower, open end of the respective capping element. Each rinsing cap 46 is provided with an essentially cylindrical circumferential wall 47 that, when the rinsing cap 46 is placed upon a capping element 7, tightly surrounds the portion 26; the rinsing cap 46 also has an end 48. To enable securement of a respective rinsing cap 46, a snap-type closure is provided that is formed from several balls 49 and a ring 50 that cooperates with these balls and is axially displaceable. The balls 49 are disposed in bores in the circumferential wall 47 in such a way that they are displaceable radially relative to the central axis M so that when the ring 50 is in its lower position, the balls 49 are pressed radially inwardly by this ring and respectively engage, via a partial surface, in an annular groove 51 that is provided in the outer surface of the portion 26. In this way, the rinsing cap 46 is held on the underside of the pertaining capping element 7 and in particular in such a way that a gap remains between the inner surface of the end 48 and the end face 35 disposed thereabove.

If the ring 50 is moved upwardly out of the resting position illustrated in FIG. 2, the balls 49 can deflect outwardly radially relative to the central axis M and hence are no longer in engagement with the groove 51, so that the rinsing cap 46 can be removed. The construction is, of course, such that the balls 49 cannot fall out of the bores provided in the wall 47 in any of the possible positions of the ring 50.

The release position of a cork or cap transfer mechanism 54 is provided below the path of movement of the capping elements 7, and in the direction of rotation of the table 6, between the bottle discharge, which is preferably formed by a transport star 52 and on which the closed bottles 2 are removed from the table 6 and are transferred via this transport star 52 to a conveying mechanism 53 for withdrawal, and a bottle inlet, which is preferably also formed by a transport star and to which the bottles 2 that are to be capped are transferred to the table 6. As is known, the cap transfer mechanism 54 serves to convey the closure caps or crown corks 3 that are supplied to a cap feeding channel 56 from a magazine 55 and that are available at the bottom end of the channel 56, and in particular the transfer mechanism 54 conveys the caps one after the other, and synchronously with the rotation of the table 6 and the capping elements 7, to the removal position of the transfer mechanism 54, so that every time a capping element 7 passes by, a cap 3 that is available at this release position in a prescribed position is picked up by the pertaining capping element 7, i.e. the hold-down device 22 thereof, and is moved along with the capping element 7 via the permanent magnet on the underside of the hold-down device 22. The cap transfer mechanism 54 comprises, in a known manner, essentially a disk 57, the axis of which is disposed in a vertical direction, with the disk 57 itself being secured to the bottom end of a shaft 58. Mounted above the disk 57 on the shaft 58 is a support element 59 that does not rotate along with the shaft 58, and which in addition to the disk 57 is provided with necessary, stationary functional elements of the transfer mechanism 54, such as a guide curve for laterally guiding the crown corks or caps 3 during transport via the disk 57 from the end 56' of the channel 56 to the release position, etc. The support element 59 is fixedly connected to the bottom end of a stationary hollow shaft 60 that surrounds the shaft 58, extends from the support element 59 to beyond the upper side of the bracket 13, and in which the shaft 58 is mounted. The hollow shaft 60 is in turn surrounded by a further, stationary hollow shaft 61 that projects beyond the underside of the bracket 13, to which the upper end of the hollow shaft 61 is secured. In the hollow shaft 61, the hollow shaft 60 as well as the shaft 58 and that portion of the transfer mechanism 54 that includes the disk 57, the support element 59, and all of the functional components provided there, are displaceable in the axial direction of the shaft 58, and in particular against the effect of a compression spring 62, out of the upper position illustrated in FIG. 4 into a lower position. To keep the support element 59 from turning, the lower end of a guide bolt that is disposed parallel to the axis of the shaft 58 is secured on the support element 59; this guide bolt is displaceably guided in a guide member 59' on the outer hollow shaft 61.

Figure 4:
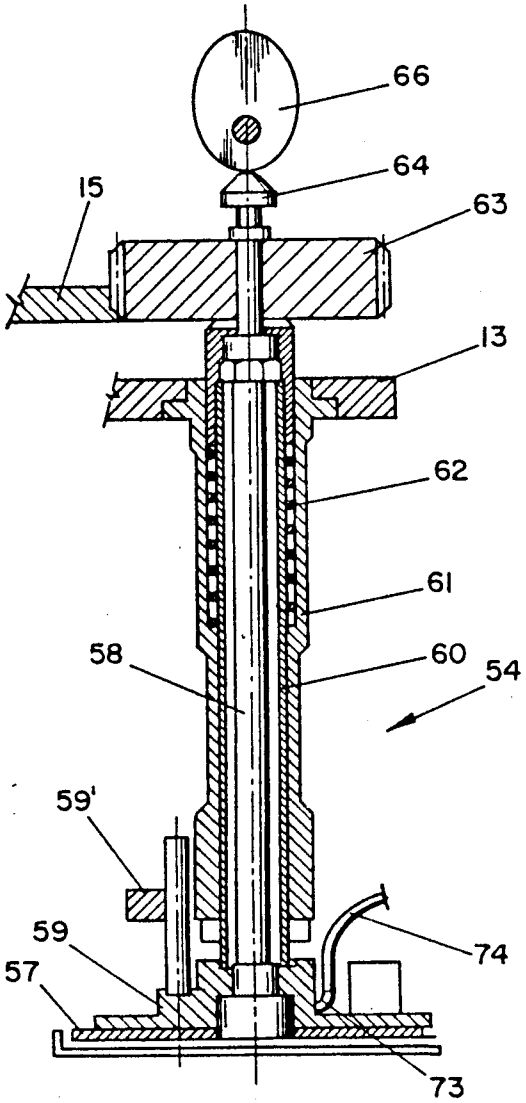
FIG. 4 is a cross-sectional view of part of a cap closure or cork transfer mechanism that essentially comprises a driven disk, which forms the cap transfer element and rotates about a vertical axis, together with a vertical shaft that is provided with this disk as well as a support and a drive means for this shaft.

Provided on the upper end of the shaft 58 that projects beyond the hollow shafts 60 and 61 is a gear wheel 63 that has such a width that this gear wheel meshes with the gear wheel 15 not only in the upper rest position of the transfer mechanism 54 illustrated in FIG. 4, but also in the previously described lower stroke position of the transfer mechanism 54. The gear wheels 15 and 63 effect the necessary drive of the transfer mechanism 54 that is synchronous with the rotation of the table 6 and the capping elements 7.

The upper end of the shaft 58, which projects beyond the upper side of the gear wheel 63 and in the illustrated embodiment is formed by a head 64 that runs in ball bearings, cooperates with an actuating mechanism 65 that effects the previously described lowering of the transfer mechanism 54 out of its upper position into the lower stroke position, and that in the illustrated embodiment is formed by an eccentric 66, which is operated by a servo-motor or rotary drive, and in particular in the illustrated embodiment by a pneumatic rotary drive 67. It is to be understood that the actuating mechanism 65 could also be formed by a lifting or pneumatic cylinder, or some other type of adjustment mechanism.

FIG. 1 shows the actuating mechanism 65 in a state in which the cap transfer mechanism 54 is lowered against the effect of the compression spring 62, and in particular to such an extent that the disk 57, the lower end of the shaft 58, the support element 59, as well as all of the further functional elements provided there, and also the end 56' are introduced from above into a tray 68 that is open at the top and is stationarily provided in the vicinity of the transfer mechanism 54. The tray 68 is preferably removable, especially if a small construction is desired for the capping machine 1 where only little space is available between the bottle discharge formed by the transport star 52 and the bottle inlet that is similarly formed by a transport star. The tray 68 is provided with two connections 69 and 70, namely an upper connection 69 that acts as an overflow and establishes a certain liquid level in the tray 68, as well as a lower connection 70 that serves as an outlet for emptying the tray 68 and in which is provided a valve, preferably a manual valve 71. The two connections 69 and 70 lead to a line 72.

Furthermore the support element 59 is also provided with a connection 73 for a hose or conduit 74 via which cleaning or rinsing agent is supplied for cleaning or disinfecting; this cleaning or rinsing agent is discharged at non-illustrated openings on the support element 59. The cleaning or rinsing agent is supplied from a supply tank 75 that is connected to the lines 78 and 79 via a pump 76 and a line 77. A solenoid valve 81 is provided in the line 78, which via a rotary distribution mechanism 80, or a portion thereof, communicates with the conduit 42 that leads to the capping elements 7. The line 79, which communicates with the connection 73, i.e. with the conduit 74, is provided with a solenoid valve 82. Furthermore, the line 78 is connected via a solenoid valve 83 with a non-illustrated source of inert gas, such as $CO_2$. The conduits 41 of the capping elements 7 are connected via the rotary distribution mechanism 80, or a further portion thereof, with a line 84 that leads back to the supply tank 75. It is to be understood that the flow medium paths that lead from the line 78 to the conduits 42, or from the conduits 41 to the line 84, are completely separate from one another in the rotary distribution mechanism 80.

The previously described apparatus makes it possible in a particularly straightforward manner to easily yet thoroughly clean or disinfect all parts of the capping elements 7 that come into contact with the bottles 2 in the region of their mouths, as well as with the crown corks or closure caps 3, as well as the transfer mechanism 54, and in particular at the beginning or at the end of a production shift or at any other point in time where it is deemed necessary to do so.

To clean the capping elements 7, the rinsing caps 46 are placed thereupon as illustrated in FIG. 2. Then, with the solenoid valve 81 open, rinsing agent is conveyed via the pump 76 and the rotary distribution mechanism 80 to the conduits 42, from which the rinsing agent respectively enters the lower annular channel 37 of each capping element, and from there passes via the two channels 32 and 33 into the region of the lower end face 35 (through the channel 32) as well as partially directly into the recess 27 (via the channel 33) that is closed at the bottom by the rinsing cap 46. The rinsing agent then flows in the annular gap 28 formed between the hold-down device 22 and the inner surface of the ring 29 and upwardly into the annular space 23, from which the rinsing agent can flow off via the holes 38 into the respectively upper annular channel 36 and the connected conduit 41, and in particular via the rotary distribution mechanism 80 and the line 84 back into the supply tank 75. As a consequence of the described flow path, which results for the rinsing fluid in each capping element, the surfaces and parts located there for which cleanliness is particularly critical (end face 35, all of the surfaces of the recess 27, all of the surfaces of the hold-down device 22, all of the surfaces of the ring 29, as well as all of the surfaces adjoining this ring, namely the surfaces adjoining the annular space 23, etc.) have rinsing fluid flow intensively thereabout and are hence reliably cleaned or disinfected. With an appropriate construction of the rotary distribution mechanism 80, i.e. if this mechanism has an effective angle of 360°, the cleaning of the capping elements 7 described above can be undertaken when the capping machine 1 is stationary.

However, if immediately prior to capping the bottles 2 a $CO_2$ rinsing is effected, i.e. that region of the mouth of the respective bottle 2, and in so doing in particular also the pertaining interior, is acted upon by an inert gas, such as $CO_2$, as will be described in detail subsequently, in this situation, already to avoid too high of a gas consumption, the rotary distribution mechanism 80 is embodied in such a way that it is effective in only a small angular range, i.e. in an angular range of approximately 90° prior to the actual capping process, so that the cleaning of the capping elements 7 described above can be effected only when the capping machine is operating. The described embodiment has the advantage that for the cleaning of the capping elements 7, and after the cleaning thereof, no conduit connections with the appropriate rinsing caps 46 have to be established or released respectively.

To clean or disinfect the transfer mechanism 54 and the elements disposed there for which a clean state is particularly critical, by activating the actuating mechanism 65, the transfer mechanism 54, i.e. the disk 57, the lower end of the shaft 58, the support element 59, the parts provided there, and the end 56' are lowered into the tray 68, as illustrated in FIG. 1. For the actuation of the actuating mechanism 65, the servo motor 67 thereof is supplied with compressed air via the line 85. After the solenoid valve 82 is opened cleaning or rinsing agent flows via the line 79 and the line 74 to the support element 59, where it discharges at the discharge openings, so that all of the particularly critical surfaces have rinsing agent flowing therearound, with the liquid level of this rinsing agent then rising, when the valve 71 is closed, to a level determined by the overflow 69 and flowing out of the tray 68 via the line 72. The aforementioned level is selected in such a way that all of the critical parts of the transfer mechanism 54 are also eventually immersed in the rinsing agent that is present in the tray 68. After the transfer mechanism 54 has been cleaned, the tray 68 is emptied by opening the valve 71. At the same time, or previously, by appropriate control of the actuating mechanism 65 the transfer mechanism 54 is returned to its rest position.

Especially where the capping machine 1 is part of a combination machine that is also provided with further machines (filling machines), it is expedient to provide on the capping machine 1 an auxiliary drive for the bracket 8 that is provided with the capping elements 7 in order in this manner, without having to activate the entire combination machine, to be able to advance only the bracket 8 ahead in stages when the rinsing caps 46 are placed on or removed in such a way that this placement or removal can be undertaken in a particularly convenient manner from one side that is also easily accessible. This auxiliary drive, which is indicated by the reference numeral 86 in FIG. 1, comprises, in the illustrated embodiment, a pneumatic rotary drive with a similarly pneumatically actuatable coupling mechanism which is formed in such a way that a pinion 87 that is provided on the output shaft of the rotary drive can be brought into or out of engagement with the gear wheel 15 in a pneumatically controlled manner, i.e. via a pneumatic cylinder. A compressed air line 88 is provided for the auxiliary drive 86; also for this auxiliary drive 86 the appropriate control valves are not shown.

The cleaning of the capping elements 7 as well as of the cork or cap transfer mechanism 54 is preferably effected simultaneously. However, the cleaning can also be undertaken at different times. Furthermore, the cleaning of the transfer mechanism 54 is effected with the capping machine 1 being stationary or rotating, with the latter situation having the advantage that the rotating elements of the transfer mechanism 54 are moving in the rinsing agent, thereby achieving an even better cleaning or disinfecting.

The capping of the bottles 2 is effected in the manner that is customary with machines of this type. In other words, at the bottle inlet, each bottle 2 is positioned under a capping element 7 that is already provided with a closure cap or crown cork 3. The capping element 7 is then lowered, so that the mouth of the bottle passes into the recess 27; subsequently, the closure cap 3 is pressed against the mouth of the bottle with the hold-down device 22, and finally by deforming the curved rim via the ring 25, this rim of the cap 3 is pressed beneath the bead of the bottle mouth and is thereby fixed in position. Prior to this final closure, i.e. when the respective capping element 7 is moved downwardly out of its uppermost position and the recess 27 thereof approaches the mouth of the bottle 2 disposed therebelow, the conduit 42 supplies $CO_2$ gas which, as a result of the narrowing at the lower end of the channel 32, flows mainly via the channel 33 and the portion 33' into the recess 27, and in particular immediately below the crown cork or cap 3 that is held on the underside of the hold-down device 22. As a result, first of all air that is present in the recess 27 is displaced by the $CO_2$ gas. At least from this time point on, at which the pertaining capping element 7 is lowered to such an extent that the mouth of the pertaining bottle 2 extends into the recess 27, in other words as shown in FIG. 3 the recess 27 forms a space that is also closed off toward the bottom by the bottle that is to be closed to such an extent that between the conical surface of the recess 27 and the mouth of the bottle only a relatively narrow annular opening that leads to the atmosphere remains, so that a particularly intensive rinsing results, i.e. supply of $CO_2$ gas to the bottle 2, and hence in particular also such a rinsing or supply of the space formed above the level of the contents in the interior of the bottle 2. Thus, air or oxygen that has possibly passed into the bottle 2 during the tim that the bottle was being transported from the filling machine to the capping machine 1 is rinsed out or replaced by $CO_2$ gas. Since the axis A of the portion 33', and hence also the axis of the discharge opening of the channel 33, are directed upwardly at an angle, i.e. form an acute angle $\alpha$ with the central axis M, or with a vertical plane that includes this central axis, which angle is therefore less than 90°, during the $CO_2$ rinsing the stream of $CO_2$ gas that exits the portion 33' first encounters essentially the inner surface of the cap 3 that is held on the underside of the hold-down device 22, from where the gas is reflected, so that essentially a gas flow results where on the one hand the $CO_2$ gas flows to the outside in the direction of the arrows B through the aforementioned opening formed between the mouth of the bottle and the conical surface of the recess 22, thus removing air or oxygen that is present from the recess 27, and on the other hand $CO_2$ gas also flows into the bottle 2 as shown by the arrows C.

The present invention has been described in conjunction with one exemplary embodiment. It is to be understood that alterations and modifications are possible without deviating from the basic concept of the invention. For example, it is possible, in addition to being able to lower the transfer mechanism 54 or in place thereof, to provide a lifting mechanism via which the tray 68 can be raised or lowered. However, raising and lowering the transfer mechanism 54 has an advantage to the raising and lowering of the tray 68 because the tray can be disposed beyond the movement space of the capping elements 7 that rotate about the machine axis V, and hence the transfer mechanism 54 can be cleaned while the capping machine 1 is rotating.

The present invention is, of course, in no way restricted to the specific disclosure of the specification and drawings, but also encompasses any modifications within the scope of the appended claims.

What we claim is:

1. In a capping machine of rotary design to cap bottles that have lips on their mouths with closure caps that are supplied from a magazine via a cap feeding channel that leads therefrom, with the capping being effected via a plurality of capping elements that rotate about a vertical axis of said machine and can each be raised and lowered in a vertical direction, whereby to press and subsequently permanently deform or set the closure caps on the bottle mouths, each of said capping elements is provided with a deforming member accommodated in a capping element part and with a hold-down device that extends centrally through said deforming member and to the region of the lower end of which said closure caps are fed via a cap transfer mechanism that is disposed downstream of said cap feeding channel, the improvement comprising:

means for securement of a rinsing cap to a rinsing cap connection area provided on a lower portion of each capping element on said capping element part thereof, with each rinsing cap, in a secured-to-a-capping element state, closing off toward the bottom a rinsing chamber in which are disposed said deforming member as well as at least an entire end face at a lower end of said hold-down device, and at least a portion of an adjoining peripheral surface; and connection means provided directly on said capping elements, above said rinsing cap connection areas thereof, for the supply and withdrawal of a cleaning or rinsing agent to said rinsing chamber.

2. A capping machine according to claim 1, in which said cap transfer mechanism is provided with a member that is driven synchronously with the rotation of said capping elements and transfers a respective one of said closure caps to holding means at the lower end of said hold-down device of each capping element that moves past a transfer position of said cap transfer mechanism.

3. A capping machine according to claim 2, wherein:

below said cap transfer mechanism, a tray-like element is provided that is open toward the top and is adapted to accommodate cleaning or rinsing agent; and at least one of said cap transfer mechanism and said tray-like element is disposed on a machine frame structure in such a way as to be movable relative to one another in such a way that in a first position, said member of said cap transfer mechanism is disposed above said tray-like element above the level of cleaning or rinsing agent therein, and in a second position, said member of said cap transfer mechanism is immersed in said tray-like element in cleaning or rinsing agent therein.

4. A capping machine according to claim 3, in which in said second position, a portion of said cap feeding channel ending at said cap transfer mechanism is also immersed in said tray-like element in cleaning or rinsing agent therein.

5. In a capping machine of rotary design to cap bottles that have lips on their mouths with closure caps that are supplied from a magazine via a cap feeding channel that leads therefrom, with the capping being effected via a plurality of capping elements that rotate about a vertical axis of said machine and can each be raised and lowered in a vertical direction, whereby to press and subsequently permanently deform or set the closure caps on the bottle mouths, each of said capping elements is provided with a deforming member and a hold-down device that extends centrally through said deforming member, with said deforming member and said hold-down device being movable relative to one another, and with a member of a cap transfer mechanism, which member is disposed downstream of said cap feeding channel and is driven synchronously with the rotation of said capping elements, transferring a respective one of said closure caps to holding means at the lower end of said hold-down device of each capping element that moves past a transfer position of said cap transfer mechanism, the improvement wherein:

below said cap transfer mechanism, a tray-like element is provided that is open toward the top and is adapted to accommodate cleaning or rinsing agent; and at least one of said cap transfer mechanism and said tray-like element is disposed on a machine frame structure in such a way as to be movable relative to one another in such a way that in a first position, said member of said cap transfer mechanism is disposed above said tray-like element above the level of cleaning or rinsing agent therein, and in a second position, said member of said cap transfer mechanism is immersed in said tray-like element in cleaning or rinsing agent therein.

6. A capping machine according to claim 5, in which in said second position, a portion of said cap feeding channel ending at said cap transfer mechanism is also immersed in said tray-like element in cleaning or rinsing agent therein.

7. A capping machine according to claim 5, including:

means for securement of a rinsing cap to a rinsing cap connection area provided on a lower portion of each capping element, with each rinsing cap, in a secured-to-a-capping element state, closing off toward the bottom a rinsing chamber in which are disposed said deforming member as well as at least an entire end face at a lower end of said hold-down device, and at least a portion of an adjoining peripheral surface; and connection means provided directly on said capping elements, above said rinsing cap connection areas thereof for the supply and withdrawal of a cleaning or rinsing agent to said rinsing chamber.

8. A capping machine according to claim 7, in which each of said capping elements is provided with a first channel and a second channel; in which said connection means includes a first connection, via which said first channel is connected to a first conduit for the supply of cleaning or rinsing agent, with said first channel emerging via at least one first channel opening into said rinsing chamber; and in which said connection means includes a second connection, via which said second channel is connected to a second conduit for the withdrawal of cleaning or rinsing agent, with said second channel communicating via at least one second channel opening with said rinsing chamber.

9. A capping machine according to claim 8, in which said first channel communicates via its at least one first channel opening with a first portion of said rinsing chamber that is disposed axially beneath said deforming member; and in which said second channel communicates via its at least one second channel opening with a second portion of said rinsing chamber that is disposed axially above said deforming member, said second portion advantageously forming a movement space for said hold-down device.

10. A capping machine according to claim 8, in which said second channel communicates via its at least one channel opening with a first portion of said rinsing chamber that is disposed axially beneath said deforming member; and in which said first channel communicates via its at least one channel opening with a second portion of said rinsing chamber that is disposed axially above said deforming member, said second portion advantageously forming a movement space for said hold-down device.

11. A capping machine according to claim 8, in which one of said first and second channels is provided with at least one channel opening at a surface formed on the underside of said capping element.

12. A capping machine according to claim 8, in which said cleaning or rinsing agent is a cleaning or rinsing liquid.

13. A capping machine according to claim 8, in which said first connection for supplying cleaning or rinsing agent is selectively connectable, via control valve means, to a source of inert gas.

14. A capping machine according to claim 8, in which in the lower portion of each capping element is provided a centering member in which, below said deforming member, to center the mouth portion of a respective bottle that is to be closed, is formed, as part of said rinsing chamber, a recess, at least a portion of which widens downwardly in the manner of a cone or truncated cone, with said recess being open at the underside of said centering member, whereby during transfer of a closure cap in a transfer position, the underside of said centering member is disposed in the vicinity of the plane of the bottom end of said hold-down device, with said rinsing cap connection area being provided on the respective centering member.

15. A capping machine according to claim 14, which includes at least one opening means for discharge of cleaning or rinsing agent at the underside and in said recess of said centering member.

16. A capping machine according to claim 14, in which at least one of said first and second channels is an annular channel that concentrically surrounds a central axis of the respective capping element.

17. A capping machine according to claim 14, in which said at least one first channel opening of said first channel is formed by a discharge opening of a branch channel that branches off from said first channel and is provided in said lower portion of said capping element or in a peripheral wall of said essentially sleeve-like centering member.

18. A capping machine according to claim 17, which includes at least one of said branch channels, at least a portion of which extends parallel to a central axis of said capping element.

19. A capping machine according to claim 14, in which said first channel has at least one channel opening at the underside of said centering member and in the interior of said recess.

20. A capping machine according to claim 19, in which said channel opening of said first channel provided on the underside of said centering member has a cross-sectional are that is less than the cross-sectional area of said channel opening provided in said recess of said centering member.

21. A capping machine according to claim 8, in which each of said rinsing caps, to effect securement thereof on a capping element, is provided with a snap-type closure, preferably a ball-retainer snap-type closure.

22. A capping machine according to claim 8, which includes at least a rotary distribution mechanism portion for connecting said first conduits of said first channels, as well as said second conduits of said second channels, of all of said capping elements, to an external supply and withdrawal line respectively.

23. A capping machine according to claim 22, in which said at least a rotary distribution mechanism portion is effective over an angular range of 360°.

24. A capping machine according to claim 22, in which said at least a rotary distribution mechanism portion is effective over an angular range of less than 360°.

25. A capping machine according to claim 8, which includes means for raising and lowering, in a vertical direction, at least said member of said cap transfer mechanism.

26. A capping machine according to claim 8, which includes means for raising and lowering, in a vertical direction, at least said tray-like element.

27. A capping machine according to claim 8, in which said tray-like element is provided with an overflow means, to define a cleaning or rinsing agent level there, as well as drain means for emptying said tray-like element.

28. A capping machine according to claim 8, which includes, in addition to a main drive means, an auxiliary drive means for the rotation, about a vertical machine axis, of a bracket that carries said capping elements.

29. A capping machine according to claim 13, in which said inert gas is $CO_2$ gas.

30. A capping machine according to claim 24, in which said at least a rotary distribution mechanism portion is effective over an angular range of about 90°.

* * * * *

UNITED STATES PATENT AND TRADEMARK OFFICE

CERTIFICATE OF CORRECTION

PATENT NO. : 5,040,354

DATED : 20 August 1991

INVENTOR(S) : EGON AHLERS ET AL

It is certified that error appears in the above-identified patent and that said Letters Patent is hereby corrected as shown below:

Please add the first name of the third inventor in this patent, so that item [75] reads as follows:

[75] Inventors: Egon Ahlers, Neu-Bamberg; Herbert Bernhard, Wolfsheim; Ludwig Clüsserath, Bad Kreuznach; Axel Theine, Wollstein; all of Federal Republic of Germany.

Signed and Sealed this

Third Day of November, 1992

*Attest:*

DOUGLAS B. COMER

*Attesting Officer*

*Acting Commissioner of Patents and Trademarks*